United States Patent [19]

Ketterer

[11] Patent Number: 4,483,264

[45] Date of Patent: Nov. 20, 1984

[54] HANGING BOBBIN CASE

[75] Inventor: Stanley J. Ketterer, Jamesburg, N.J.

[73] Assignee: The Singer Company, Stamford, Conn.

[21] Appl. No.: 364,545

[22] Filed: Apr. 1, 1982

Related U.S. Application Data

[63] Continuation-in-part of Ser. No. 170,389, Jul. 21, 1980, abandoned.

[51] Int. Cl.[3] ..... D05B 57/26

[52] U.S. Cl. ..... 112/231

[58] Field of Search ..... 112/181, 189, 228, 230, 112/231

[56] References Cited

U.S. PATENT DOCUMENTS

| | | | |
|---|---|---|---|
| 239,998 | 4/1881 | Willcox et al. | 112/181 |
| 1,269,686 | 6/1918 | DeVoe | 112/181 |
| 1,548,464 | 8/1925 | Hemleb | 112/181 |
| 2,420,536 | 5/1947 | Hohmann | 112/181 |

FOREIGN PATENT DOCUMENTS

| | | | |
|---|---|---|---|
| 2801599 | 7/1978 | Fed. Rep. of Germany | 112/231 |
| 747528 | 4/1956 | United Kingdom | 112/231 |

*Primary Examiner*—Wm. Carter Reynolds

*Attorney, Agent, or Firm*—Robert E. Smith; Edward L. Bell

[57] ABSTRACT

A hanging bobbin case in a sewing machine having a horizontal axis rotating hook is disclosed. The weight of the bobbin case is vertically supported by a finger portion of a bracket which is hingeably attached to the machine frame for easy removal of the bobbin. Projections formed in the bracket limit sideways movement of the bobbin case for preventing contact with the interior walls of the hook.

4 Claims, 7 Drawing Figures

Fig. 1
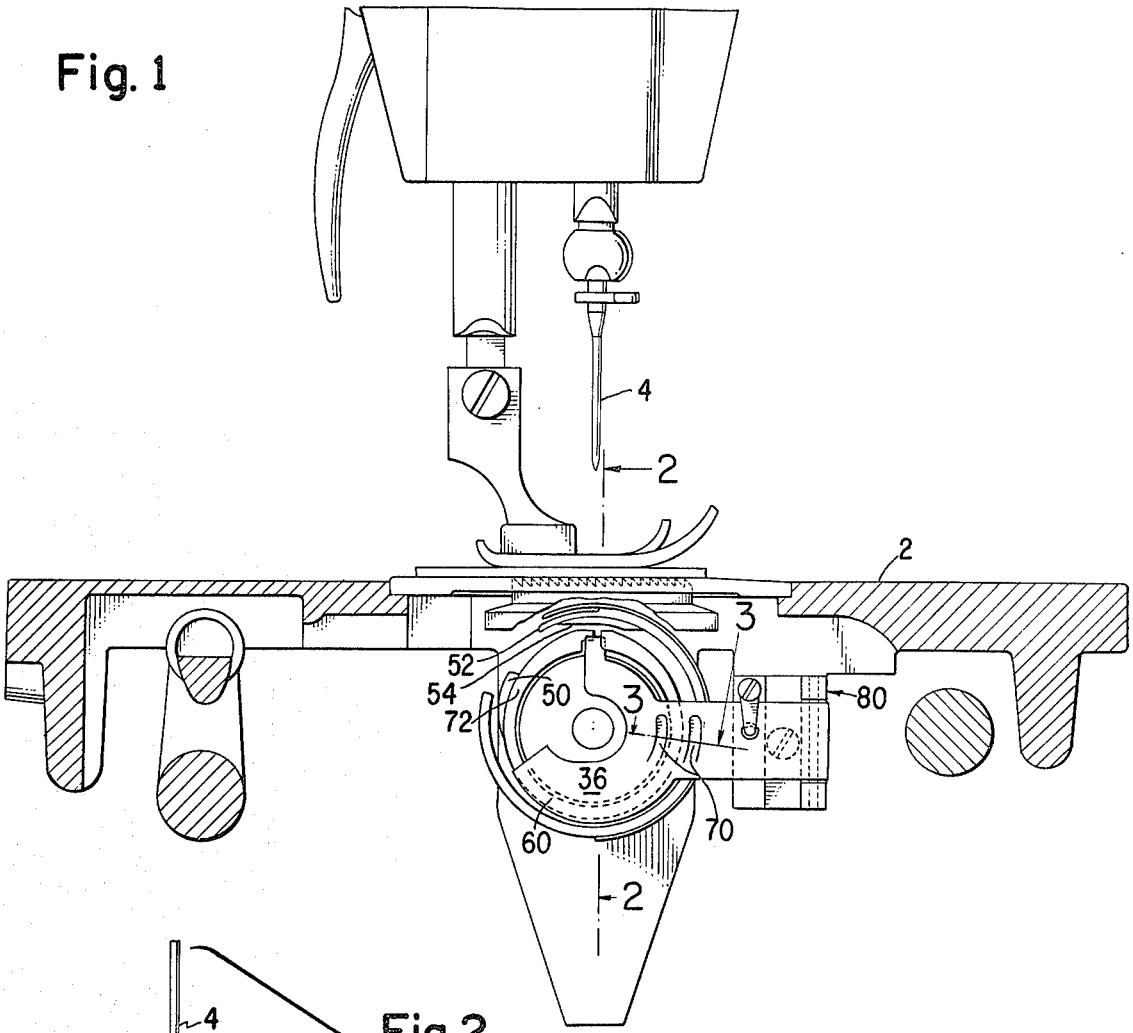
Fig.2
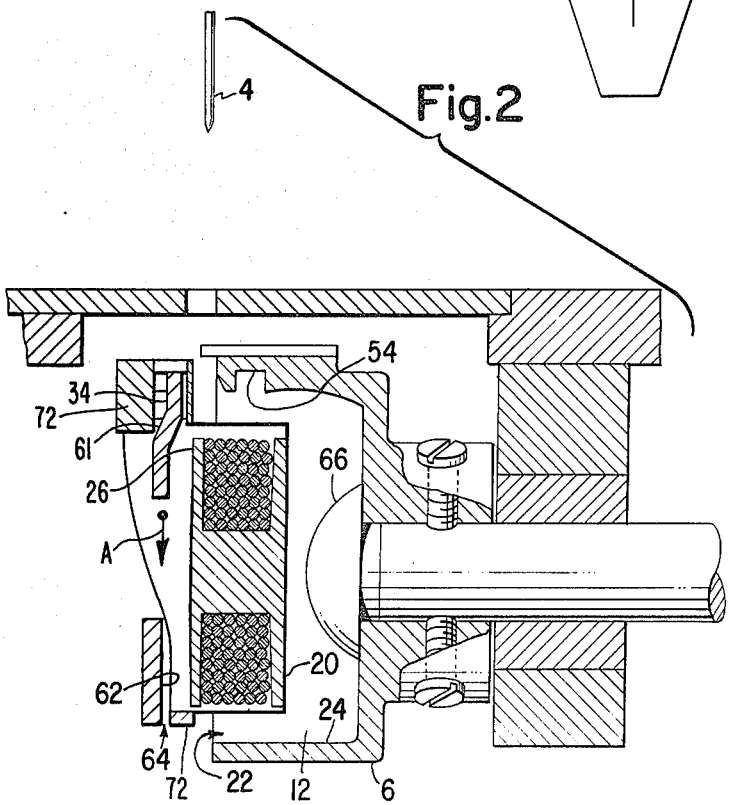
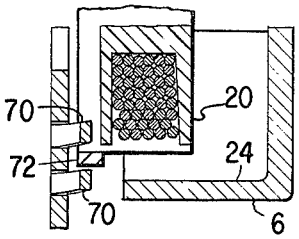
Fig.3

Fig. 4
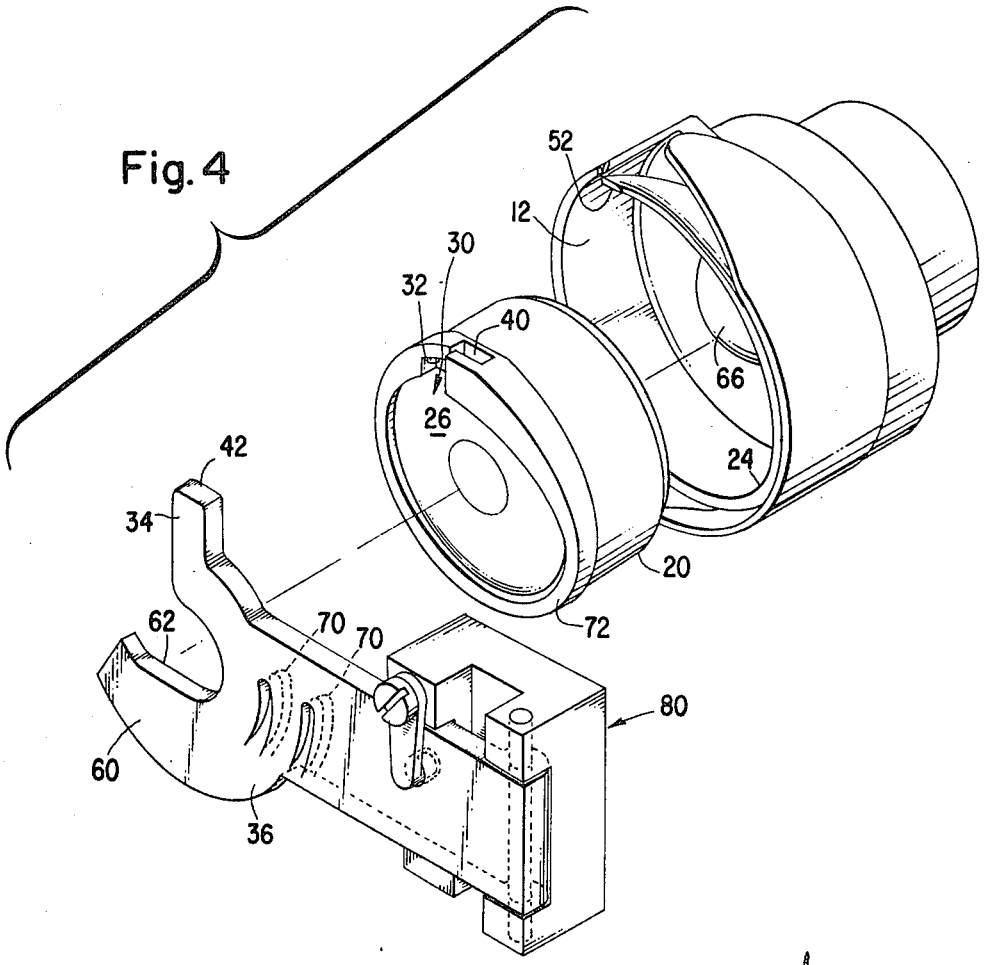
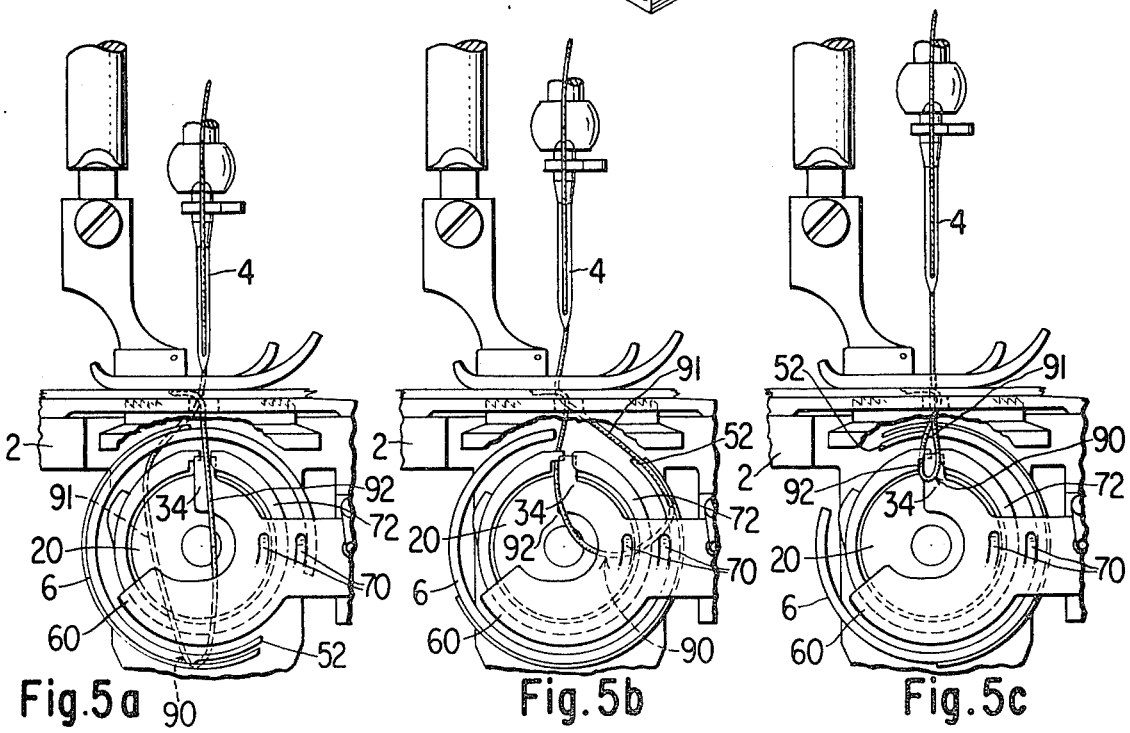
Fig.5a Fig.5b Fig.5c

HANGING BOBBIN CASE

DESCRIPTION

This is a continuation in part of application Ser. No. 170,389, filed July 21, 1980, now abandoned.

BACKGROUND OF THE INVENTION

This invention relates to a bobbin case for a sewing machine having a horizontal axis rotating hook and, more particularly to the support thereof.

In a sewing machine having a horizontal axis rotating hook there is traditionally provided an open cavity formed in the free end of the hook, the cavity having an annular raceway formed therein. The bobbin case has a structure that closely mates with this raceway thereby providing bearing support so that the weight of the bobbin case is supported by the rotating raceway while the bobbin case is restrained from rotation. Inherent in this type of construction is the necessity to manufacture the parts to very close tolerance, thus, increasing their costs. Additionally, the raceway must be lubricated in order to achieve a reasonable operating life. Another disadvantage of this construction is that lint frequently accumulates in the confined area between the bobbin case and the cavity walls of the hook, requiring frequent cleaning. One method to alleviate some of these problems is disclosed in U.S. Pat. No. 239,998, Apr. 12, 1881, Willcox et al, which describes a hanging bobbin case that is suspended from a stationary support finger. There is sufficient clearance between the bobbin case and the internal walls of the hook to permit passage of a loop of thread. This clearance, however, is minimized so that the walls of the hook will limit sideways movement of the bobbin case. Thus, in operation the bobbin case, due to a variety of causes such as forces exerted through the thread by the beak and the take up lever and vibrations normally occurring in the sewing machine, will swing from side to side and thereby contact the internal walls of the rotating hook. This can intermittently inhibit passage of the loop of thread thereby adversely affecting stitch formation particularly when such interference with passage of the thread occurs while the needle thread loop is being expanded and drawn about the bobbin case by the loop taker. The present invention overcomes these difficulties of the prior art by the use of novel but relatively simple structure.

SUMMARY OF THE INVENTION

It is an object of this invention to provide a support for a bobbin case that substantially prevents deleterious contact between the bobbin case and the walls of the rotating hook. It is also an object of this invention to eliminate the internal raceway of the hook for supporting the bobbin case.

Another object of this invention is to provide a construction for supporting a bobbin case in sewing position with respect to a loop taker entirely by support means that is carried by the machine frame and that engages only those surfaces on the bobbin case which are traversed by needle thread loops after cast-off from the loop taker beak.

Other objects and advantages of the invention will become apparent through reference to the accompanying drawings and descriptive matter which illustrate a preferred embodiment of this invention.

According to the present invention there is provided a sewing machine having a hook adapted for rotation about a horizontal axis. The hook has formed in one end thereof an open ended cavity. A support means is arranged for supporting the bobbin case in the vertical direction while it is positioned within the cavity. There is a guide means for limiting sideways movement of the bobbin case and thereby preventing contact with the interior walls of the cavity.

BRIEF DESCRIPTION OF THE DRAWINGS

In order that the invention be more fully understood, it will not be described by way of example with reference to the accompanying drawings in which:

FIG. 1 is a right end view of a sewing machine showing structure incorporating the teachings of this invention;

FIG. 2 is a partial cross section view taken along lines 2—2 of FIG. 1;

FIG. 3 is a partial cross section view taken along lines 3—3 of FIG. 1;

FIG. 4 is a partial perspective view showing the hook, bobbin case, bobbin, and bobbin case support bracket.

FIGS. 5*a*, 5*b*, and 5*c* are three end elevational views of the needle, loop taker, bobbin case and bobbin case support means of this invention showing the needle thread loop in three successive positions during a typical cycle of stitch formation, in which;

FIG. 5*a* shows the thread loop fully expanded by the loop taker beak and just prior to cast-off of the thread loop from the beak;

FIG. 5*b* shows the thread loop shortly after cast-off from the loop taker beak and during passage thereof between the bobbin case and the bobbin case guide elements on the bobbin case support means of this invention; and FIG. 5*c* shows the thread loop as it is being drawn between the bobbin case and the bobbin case supporting element of the support means of this invention.

DETAILED DESCRIPTION OF THE INVENTION

Referring to FIGS. 1, 2 and 3, there is shown a sewing machine having a bed 2, a reciprocating thread carrying needle 4 arranged for cooperative engagement with a hook 6 for the formation of lock stitches. The hook 6 is journalled for rotation in the bed 2 and has a horizontal axis of rotation.

An open ended cavity 12 is formed in the hook 6 and adapted to receive, with clearance, the bobbin case 20. There is sufficient clearance at 22 for a loop of thread to pass between the bobbin case 20 and the internal walls 24 of the cavity 12. The bobbin case 20 is adapted to receive a bobbin 26 and enclose the periphery and one side thereof. A conventional thread tensioning device, not shown, integral to the bobbin case in a way that is well known to those skilled in the art is employed to provide proper thread tension for the formation of lock stitches.

A recess 30 is formed in the periphery of the bobbin case 20 radially above the center of gravity of the bobbin case and adjacent the path of reciprocation of the needle 4. The recess 30 has an annular surface 32 which overlies and rests upon a top surface 42 of a finger 34 which provides a first bobbin case contacting element on a stationary bracket 36. The finger 34 serves to support the weight of the bobbin case 20 in the vertical direction. The recess 30 has formed therein a U-shaped retainer 40 for partially encircling the finger 34 and providing a coupling between the bracket 36 and the bobbin case 20 for preventing rotation thereof. The coupling is sufficiently loose to provide adequate space for a loop of thread to pass therebetween while retaining the two parts in engagement. In operation, the abutting surface 32 which rests on a portion of the top surface 42 of the finger 34 and will rise slightly under the pressure which the loop of thread exerts as it is being pulled up by the conventional needle thread take up mechanism, not shown. This slight rising of the surface 32 with respect to the surface 42 is sufficient to permit passage of the loop of thread. A short guide fin 50 is positioned on the periphery of the bobbin case 20 and cooperates with the hook 6 to spread the loop of thread which is picked up by the beak 52. A short U-shaped channel 54 is adapted to straddle the fin 50 as the loop of thread is spread thereby in order to control the limbs of needle thread loop in passage about the bobbin case in stitch formation.

An end portion 60 of the bracket 36 having a thread guide surface 62 is arranged to guide one limb of the needle thread loop between the guide surface 62 and the bobbin case 20 as the thread loop is being cast about the bobbin case. As shown in FIGS. 1, 2 and 4, the finger 34 of the supporting bracket engages the recess 30 at substantially the highest point on the bobbin case when in sewing position within the loop taker cavity. Preferrably, the finger 34 is offset toward the hook as at 61 sufficiently into vertical alignment with the center of gravity of the bobbin case 20, and of the bobbin case 20 with a bobbin 26 therein as indicated by the arrow a in FIG. 2, that the bobbin case will be suspended free of not only the hook 6 but also free of the bracket 36 with clearance indicated at 64 therebetween when the parts are in equilibrium.

Under the influence of forces exerted by the thread, the bobbin case 20 may be caused to swing carrying the lower edge lightly against the surface 62 or causing the bobbin case to swing back toward the interior of the hook 6 as the thread loop is pulled through by the conventional needle thread take up mechanism substantially at cast-off of the loop from the loop taker beak. A spherical stop member 66 axially attached to the interior of the hook 6 limits any such accidental movement of the bobbin case inwardly of the loop taker cavity and thereby damps undesirable oscillating movements of the bobbin case 20.

Two projections 70 formed in the bracket 36 provide guide means for constraining the bobbin case 20 from swinging about the support finger 34 and into contact with the sidewalls of the hook, the projections 70 project from the surface 62 toward the bobbin case 20 sufficiently far so that they straddle the wall 72 of the bobbin case at a point laterally opposite the center of the bobbin case. This construction limits sideways movement of the bobbin case preventing it from contacting the walls 24 of the rotating hook 6 and does not provide any impediment to passage of the thread loop until well after loop cast-off from the beak as will be explained in detail below. The projections 70 are positioned with respect to the wall 72 so that sufficient clearance is maintained to permit easy passage of a limb of the thread loop therebetween. The projections 70 of the preferred embodiment are of arcuate shape, having substantially the same radius of curvature as the bobbin encompassing rim 72 of the bobbin case 20 as viewed in FIG. 1, but may take a different shape provided that the clearance requirements stated above are maintained. The finger 34 and projections 70 of the bracket 36 are arranged to support the weight of the bobbin case 20 and maintain it in sewing position within the cavity 12 while preventing the bobbin case from contacting the hook.

With reference to FIGS. 5*a*, 5*b*, and 5*c*, the manner in which the needle thread is manipulated to encircle the bobbin case in the formation of a lock stitch will now be described. It will be understood that as is conventional in lock stitch sewing machines, the loop taker partakes of multiple revolutions, usually two, for each needle reciprocation. Also, a needle thread take up of conventional construction (not shown) pays out slack needle thread during descent of the needle as well as during seizure and expansion of a needle thread loop by the loop taker, and retracts needle thread starting at cast-off so as to remove the needle thread loop from the loop taker beak and set the stitch into the work fabric being sewn.

FIG. 5*a* shows a needle thread loop 90 positioned substantially at cast-off, i.e. at the point of maximum expansion of the loop by the loop taker beak. The supply limb 91 of the thread loop extending from the needle behind the bobbin case and to the hook beak and the work limb 92 of the thread loop extending from the previous stitch in the work across the face of the bobbin case to the hook beak.

In the present invention from loop seizure by the hook beak until cast-off as illustrated in FIG. 5*a*, neither the supporting structure for the bobbin case nor the cooperative interrelation of the bobbin case with the loop taker provide any interference with the free passage of the needle thread loop about the bobbin case. True, the guide fin 50 on the bobbin case and the U-shaped channel 54 in the hook cavity influence the disposition of the supply and work limbs 91 and 92 determining which limb passes behind the bobbin case and determining together with the thread guard which limb passes across the face of the bobbin case; but these surfaces, like the hook beak itself, assist rather than interfere with the free passage of needle thread loops about the bobbin case. This is particularly important in lock stitch formation because, during loop seizure and loop expansion by the loop taker, the needle thread is placed in a generally slack condition by the needle thread take up mechanism and the only active manipulative effect is provided by the hook beak. Because the hook beak acts at the bight or midpoint of the needle thread loop, and because it moves for the most part at a sharp angle to the disposition of the thread limbs, the beak is not well suited to the task of drawing the thread limbs through a constriction or impediment. Even a minor constriction in the thread path between loop seizure and cast-off, i.e. to the left of the depicted thread loop position shown in FIG. 5*a* would result in a profound change in the disposition of the thread limbs and one highly disadvantageous likelihood as a result of constriction in this location is that rather than drawing the loop directly through the constriction, a distorted and oversized loop may be formed because of the slack condition of the thread limbs. As a result, imperfectly formed stitches, stitches with objectionable thread loops, or even thread breakage could result.

FIG. 5*b* shows a needle thread loop 90 as it traverses between the guide projections 70 and the rim 72 of the bobbin case. The thread loop, at this point in the stitching cycle, has been cast from the loop taker beak 52 and the sewing machine take up mechanism is drawing upwardly on the supply limb 92. By this point in the cycle, the slack has been removed from the needle thread loop and its size is being reduced, encirclement of the bobbin case has been accomplished and overcoming of a constriction can be accomplished with relative ease. More importantly, the possibility for distortion of the position of the loop is minimized and the possible adverse effects of any such distortion are reduced practically to nonexistence.

As illustrated clearly in FIG. 5*b*, the first impediment to free passage of the thread loop about the bobbin case from loop seizure adjacent the path of reciprocation of the needle is presented by the constricted passage between the guide projection 70 and the bobbin case rim 72 which is located at an angle greater than 180° (and preferrably about 220°) from the path of needle reciprocation considered in the direction of hook rotation.

FIG. 5*c* shows the needle thread loop 90 as it is being drawn between the supporting finger 34 and the recess 30. The thread loop will ultimately have to be drawn between the top 42 of the finger 34 and the abutting surface 32 on the bobbin case, and passage of the thread therebetween will require that the bobbin case be raised slightly by the thread. The upward pull of the take up on the supply limb 91, however, acts directly upon this constriction point on the thread so that all possibility of distortion of the loop and all possibility of adverse effect on the stitch formation due to such distortion is obviated.

The points of possible contact between the bobbin case and its supporting structure are in this invention arranged to occur at positions on the bobbin case where thread loops being manipulated in the formation of stitches can best accommodate whatever constrictions these support structures impose and where the forces and influences acting upon the thread loops can cause traverse of the constrictions without adverse effect upon the formation of stitches.

The stationary bracket 36 is hingeably attached at 80 to the bed 2 so that it may be hinged outwardly for easy removal of the bobbin case 20 from the interior of the hook 6 or it may be locked in a stationary position for supporting the bobbin case 20 during operation of the sewing machine. The construction of such a hinge arrangement will be readily apparent to one skilled in the art and, therefore, not described in detail here.

Upon reviewing the present disclosure, a number of alternative constructions will occur to one skilled in the art. Such constructions may utilize projections 70 of various shapes and positions to control sideways movement of the bobbin case 20 as well as different configurations for the recess 30 and finger 34. All such alternative constructions are considered to be within the spirit and scope of this disclosure.

I claim:

1. A sewing machine having a frame, a hook adapted for rotation about a horizontal axis within said frame, a thread carrying needle supported in said frame for endwise reciprocation in a path substantially radially of said hook axis, said hook having formed in one end thereof interior walls defining an open ended cavity, a bobbin case adapted for positioning within said cavity, a support means carried by said frame for constraining said bobbin case in sewing position within said hook cavity free of contact with any moving interior walls of said hook cavity, a first bobbin case contacting element on said support means for sustaining said bobbin case in the vertical direction and arranged adjacent to the path of reciprocation of said needle, a support surface complemental to said first bobbin case contacting element formed above the center of gravity of said bobbin case, guide means carried on said support means for limiting sideways movement of said bobbin case and including a second bobbin case contacting element, a guided surface formed on said bobbin case complemental to said guide means, said guide means being arranged radially outward from the axis of the hook and at an angle greater than 180° from the path of needle reciprocation considered in the direction of rotation of said hook.

2. A sewing machine as set forth in claim 1, wherein said support means comprises:

(a) a bracket having a body hingeably attached to said frame and a finger formed with a top surface adapted for supporting engagement with said bobbin case;

(b) a recess formed in said bobbin case adapted for loosely engaging said finger to effect said supporting engagement, said recess having sufficient clearance around said finger to permit the passage of a loop of thread therebetween.

3. A sewing machine as set forth in claim 1 wherein said bobbin case includes a cylindrical bobbin encompassing rim, and wherein said guide means comprises a plurality of projections adapted loosely to embrace the rim of said bobbin case with sufficient clearance to accommodate passage of a needle thread loop therebetween.

4. A sewing machine as set forth in claim 3 wherein said projections are arcuate in shape having substantially the same radius of curvature as said bobbin encompassing rim of said bobbin case.

* * * * *